US006941594B1

(12) United States Patent
Mosley

(10) Patent No.: US 6,941,594 B1
(45) Date of Patent: Sep. 13, 2005

(54) BED WITH RELATIVELY MOVABLE PARTS

(76) Inventor: Clinton L. Mosley, P.O. Box 232, West Plaines, MO (US) 65775

( * ) Notice: Subject to any disclaimer, the term of this patent is extended or adjusted under 35 U.S.C. 154(b) by 0 days.

(21) Appl. No.: 10/980,673

(22) Filed: Nov. 3, 2004

(51) Int. Cl.[7] ..... A47C 19/00; A47C 21/02
(52) U.S. Cl. ..... 5/11; 5/200.1; 5/600; 5/488
(58) Field of Search ..... 5/11, 611, 488, 5/200.1, 600

(56) References Cited

U.S. PATENT DOCUMENTS

| | | | | |
|---|---|---|---|---|
| 517,280 A | | 3/1894 | Karp | |
| 3,829,907 A | | 8/1974 | Brunner | |
| 3,887,950 A | * | 6/1975 | Wachsman | 5/11 |
| 3,987,503 A | * | 10/1976 | Kean | 5/611 |
| 4,084,274 A | | 4/1978 | Willis et al. | |
| 4,344,195 A | * | 8/1982 | Gustafson | 5/11 |
| 5,095,561 A | | 3/1992 | Green et al. | |
| 5,101,523 A | | 4/1992 | Bright | |
| D339,248 S | | 9/1993 | Johnson | |
| D357,139 S | | 4/1995 | Magistretti | |
| 5,461,740 A | | 10/1995 | Pearson | |
| 5,497,518 A | | 3/1996 | Iura | |
| 5,758,372 A | * | 6/1998 | Lopez Diaz | 5/200.1 |

FOREIGN PATENT DOCUMENTS

DE 3737411 A1 * 5/1989

* cited by examiner

*Primary Examiner*—Alexander Grosz
(74) *Attorney, Agent, or Firm*—Donald R. Schoonover

(57) ABSTRACT

A bed includes a main frame unit which rests on a floor and a mattress/box spring elevator unit that is movably connected to the main frame unit by a plurality of links so the mattress/box spring elevator unit can be moved relative to the main frame unit. The mattress/box spring elevator unit includes a first subframe unit connected to the main frame unit by springs and by the links, and a second subframe unit connected to the first subframe unit by a turntable so the second subframe unit can be rotated with respect to the first subframe unit. A mattress and box spring can be mounted on the mattress/box spring elevator unit and moved up from the main frame unit and then rotated as needed to change bedding on the mattress and box spring without requiring movement of the main frame unit.

2 Claims, 1 Drawing Sheet

BED WITH RELATIVELY MOVABLE PARTS

BACKGROUND OF THE INVENTION

1. Field of the Invention

The present invention relates to the general art of beds, and to the particular field of beds with relatively movable parts.

2. Description of the Related Art

Making a bed can be a difficult operation. The sheets and blankets must be removed and then replaced with new sheets and blankets. The old bedding must be pulled away from the box spring and mattress, and the new bedding must be inserted between the box spring and mattress.

This operation is difficult enough, but if the bed is in a hospital, and the operation must be carried out while a patient is in the bed, the difficulty of the operation is increased.

While some form fitting bedding makes placement easier than other bedding, the person making the bed is still required to move around the bed to secure the bedding to the bed. This can be difficult under any circumstances, but is exacerbated if the bed is located near a wall.

Therefore, there is a need for a bed which can be made and unmade in an efficient manner.

Still further, there is a need for a bed that can be easily made and unmade even if it is located in a difficult-to-reach location. This would be especially helpful if the person changing the bed is disabled.

OBJECTS OF THE INVENTION

It is a main object of the present invention to provide a bed which can be made and unmade in an efficient manner.

It is another object of the present invention to provide a bed that can be easily made and unmade even if it is located in a difficult-to-reach location.

SUMMARY OF THE INVENTION

These, and other, objects are achieved by a bed which comprises a base frame unit; and a mattress/box spring elevator unit which is mounted on the base frame unit and which includes a plurality of links pivotally mounted on the base frame unit, a first subframe unit mounted on the links and movable between a first position located adjacent to a plane containing the base frame unit and a second position spaced apart from the plane containing the base frame unit, a second subframe unit, a turntable rotatably connecting the first subframe unit and the second subframe unit so the second subframe unit is rotatable with respect to the first subframe unit, and a plurality of springs connecting the first subframe unit and the base frame unit and biasing the first subframe unit towards the second position thereof.

Using the bed embodying the present invention permits a bed to be made in an efficient manner. The person making the bed is not required to move around the bed thereby making the bed easier to make up even if it is located in a difficult-to-reach location.

BRIEF DESCRIPTION OF THE DRAWING FIGURES

DETAILED DESCRIPTION OF THE PREFERRED EMBODIMENT

Figure 2:
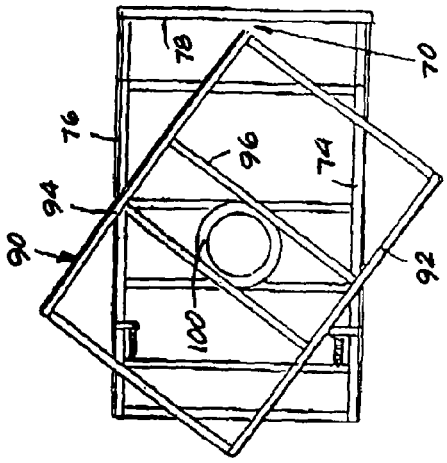
FIG. 2 is a top plan view of the bed embodying the present invention.

Other objects, features and advantages of the invention will become apparent from a consideration of the following detailed description and the accompanying drawings.

Referring to the Figures, it can be understood that the present invention is embodied in a bed 10 that achieves the above-stated objectives.

Bed 10 comprises a base frame unit 12 which has legs, such as leg 14, two side frame elements 16 and 18, two cross frame elements 20 and 22, a longitudinal axis 24 which extends between the two cross frame elements 20, 22, and a transverse axis 30 which extends between the two side frame elements 16, 18. The side frame elements 16, 18 and the cross frame elements 20, 22 are all co-planar with each other.

A mattress/box spring elevator unit 40 is mounted on base frame unit 12 and includes a plurality of links, such as link 42. Each link has a first end 44, which is a proximal end when elevator unit 40 is in use, and a second end 46, which is a distal end when elevator unit 40 is in use. Each link further includes a longitudinal axis 48 which extends between first end 44 and distal end 46 of each link. Each link further includes a proximal end pivot pin 50 which pivotally connects the proximal end 44 of each link 42 to a side frame element 16, 18 of base frame unit 12. Each link is movably mounted on base frame unit 12 to move between a stored position, indicated in dotted lines in FIG. 3, having longitudinal axis 48 extending in the direction of longitudinal axis 24 of base frame unit 12 and being located in the plane containing the side frame elements 16, 18 and the cross frame elements 20, 22 and a deployed position, shown in FIG. 1, having longitudinal axis 48 extending away from the plane containing the side frame elements 16, 18 and the cross frame elements 20, 22 with the distal end 46 of each link located spaced apart from the plane containing the side frame elements 16, 18 and the cross frame elements 20, 22. Each link further includes a distal end pivot pin 60.

Figure 3:
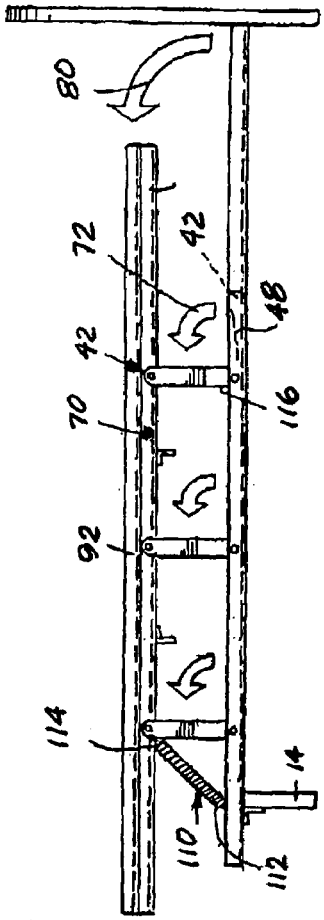
FIG. 3 is a side elevational view of the bed embodying the present invention.

A first subframe unit 70 is mounted on links 42 to be movable therewith as indicated by arrows 72 in FIG. 3. First subframe unit 70 includes two side frame elements 74 and 76. Each side frame element 74, 76 of the first subframe unit 70 is pivotally connected to the links by the distal end pivot pins 60.

A plurality of cross frame elements, such as cross frame element 78, are connected to the two side frame elements 74, 76 of first subframe unit 70. Side frame elements 74 and 76 and cross frame elements 78 of first subframe unit 70 are located in a common plane with each other.

As indicated by arrow 80, first subframe unit 70 is movable between a stored location closely adjacent to the plane containing the side frame elements 16, 18 and the cross frame elements 20, 22 of base frame unit 12 and a deployed position shown in FIG. 3, spaced apart from the plane containing the side frame elements 16, 18 and the cross frame elements 20, 22 of base frame unit 12.

A second subframe unit 90 includes two side frame elements 92 and 94 and a plurality of cross frame elements, such as cross frame element 96. The side frame elements 92, 94 and cross frame elements 96 of second subframe unit 90 are located in a common plane with each other.

Figure 1:
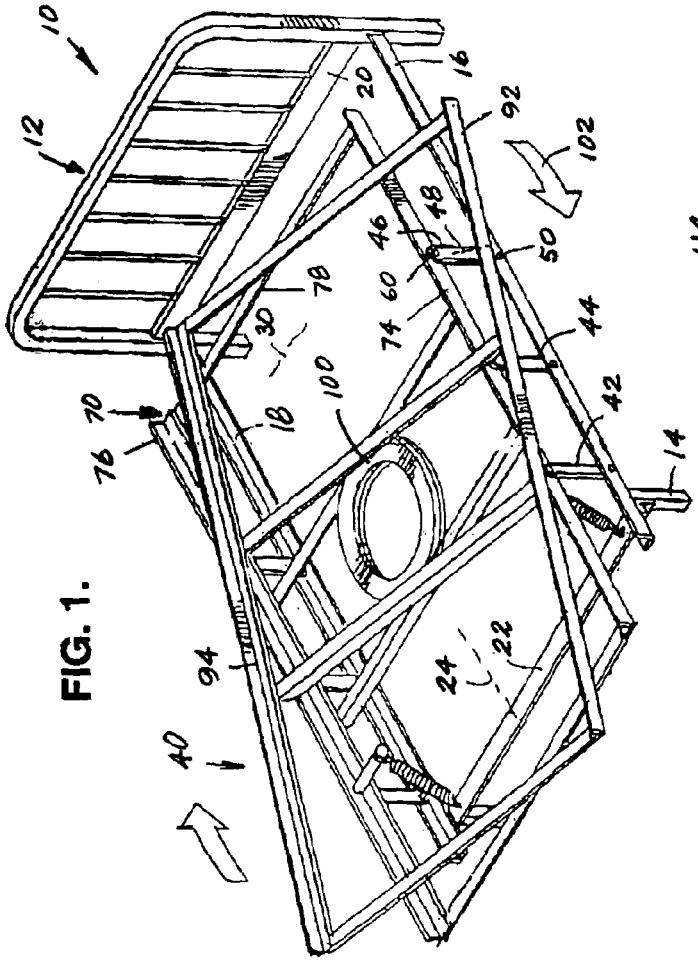
FIG. 1 is a perspective view of a bed embodying the present invention.

A turntable element 100 rotatably connects first subframe unit 70 to second subframe unit 90 so that the first subframe unit 70 can rotate with respect to the second subframe unit 90 as indicated in FIG. 1 by arrow 102. Turntable element 100 can be a thrust bearing or like element.

Mattress/box spring elevator unit 40 further includes a plurality of springs, such as spring 110. Each spring has a first end 112 attached to base frame unit 12 and a second end 114 attached to first subframe unit 70. Each spring is biased to bias first subframe unit 70 towards the deployed position. A stop, such as stop 116, can be located adjacent to each link to control movement of that link.

Figure 4:
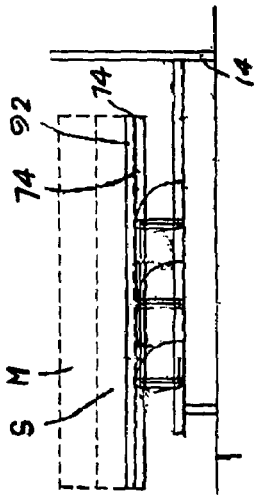
FIG. 4 is a side elevational view of the bed embodying the present invention with a mattress and a box spring in place.

Use of bed 10 can be understood from the foregoing teaching, and thus will only be briefly discussed. A mattress M and a box spring S are supported on mattress/box spring elevator unit 40 as shown in FIG. 4. When bedding is to be changed, mattress/box spring elevator unit 40 is elevated in the direction indicated by arrows 72 in FIG. 3, and then second subframe unit 90 is rotated with respect to first subframe unit 70 as indicated by arrow 102 in FIG. 1 to orient the mattress and box spring in a desired position and orientation. After the bedding is changed, the process is reversed to replace the mattress and box spring in position on base frame unit 12.

It is understood that while certain forms of the present invention have been illustrated and described herein, it is not to be limited to the specific forms or arrangements of parts described and shown.

What is needed and desired to be covered by Letters Patent is as follows:

1. A bed comprising:

(a) a base frame unit having legs, two side frame elements, two cross frame elements, a longitudinal axis which extends between the two cross frame elements, and a transverse axis which extends between the two side frame elements, the side frame elements and the cross frame elements all being co-planar with each other; and (b) a mattress/box spring elevator unit which is mounted on said base frame unit and which includes (1) a plurality of links, with each link of the plurality of links having a first end which is a proximal end when said elevator unit is in use, a second end which is a distal end when said elevator unit is in use, each link further including a longitudinal axis which extends between the first end of each link and the distal end of each link, each link further including a proximal end pivot pin pivotally connecting the proximal end of each link to a side frame element of said base frame unit, each link of the plurality of links being movably mounted on said base frame unit to move between a stored position having the longitudinal axis of the link extending in the direction of the longitudinal axis of said base frame unit and being located in the plane containing the side frame elements and the cross frame elements and a deployed position having the longitudinal axis of each link extending away from the plane containing the side frame elements and the cross frame elements with the distal end of each link being located spaced apart from the plane containing the side frame elements and the cross frame elements, each link further including a distal end pivot pin, (2) a first subframe unit mounted on the plurality of links to be movable therewith, the first subframe unit including (A) two side frame elements, each side frame element of the first subframe unit being pivotally connected to the links by the distal end pivot pins, (B) a plurality of cross frame elements connected to the two side frame elements of the first subframe unit, (C) the side frame elements and the cross frame elements of the first subframe unit being located in a common plane with each other, and (D) the first subframe unit being movable between a stored location closely adjacent to the plane containing the side frame elements and the cross frame elements of said base frame unit and a deployed position spaced apart from the plane containing the side frame elements and the cross frame elements of said base frame unit, (3) a second subframe unit including two side frame elements and a plurality of cross frame elements, the side frame elements and cross frame elements of the second subframe unit being located in a common plane with each other, (4) a turntable element rotatably connecting the first subframe unit to the second subframe unit so that the second subframe unit can rotate with respect to the first subframe unit, and (5) a plurality of springs, each spring having a first end attached to said base frame unit and a second end attached to the first subframe unit, each spring being biased to bias the first subframe unit towards the deployed position.

2. A bed comprising:

(a) a base frame unit; and (b) a mattress/box spring elevator unit which is mounted on said base frame unit and which includes (1) a plurality of links pivotally mounted on said base frame unit, (2) a first subframe unit mounted on the links and movable between a first position located adjacent to a plane containing said base frame unit and a second position spaced apart from the plane containing said base frame unit, (3) a second subframe unit, (4) a turntable rotatably connecting the first subframe unit and the second subframe unit so the second subframe unit is rotatable with respect to the first subframe unit, and (5) a plurality of springs connecting the first subframe unit and said base frame unit and biasing the first subframe unit towards the second position thereof.

* * * * *